US008146581B2

(12) United States Patent
Kitagawa et al.

(10) Patent No.: US 8,146,581 B2
(45) Date of Patent: Apr. 3, 2012

(54) METHOD FOR SLICING WORKPIECE

(75) Inventors: Koji Kitagawa, Nishishirakawa (JP); Kazuya Tomii, Nishishirakawa (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 0 days.

(21) Appl. No.: 12/990,985

(22) PCT Filed: Jun. 4, 2009

(86) PCT No.: PCT/JP2009/002516

§ 371 (c)(1),
(2), (4) Date: Nov. 4, 2010

(87) PCT Pub. No.: WO2010/001529

PCT Pub. Date: Jan. 7, 2010

(65) Prior Publication Data

US 2011/0059679 A1 Mar. 10, 2011

(30) Foreign Application Priority Data

Jun. 30, 2008 (JP) ..... 2008-171057

(51) Int. Cl.
*B28D 1/08* (2006.01)

(52) U.S. Cl. ..... 125/16.02; 125/12

(58) Field of Classification Search ..... 451/53, 451/449, 60; 125/16.02, 12
See application file for complete search history.

(56) References Cited

U.S. PATENT DOCUMENTS

| | | | | |
|---|---|---|---|---|
| 5,778,869 | A | 7/1998 | Toyama | |
| 5,893,308 | A * | 4/1999 | Katamachi et al. | 83/13 |
| 6,652,356 | B1 | 11/2003 | Ariga | |
| 7,223,155 | B2 * | 5/2007 | Matsumoto | 451/36 |

FOREIGN PATENT DOCUMENTS

| | | |
|---|---|---|
| JP | A-8-323741 | 12/1996 |
| JP | A-10-128738 | 5/1998 |
| JP | A-11-262852 | 9/1999 |
| JP | A-2002-337137 | 11/2002 |
| JP | B2-3734018 | 1/2006 |

OTHER PUBLICATIONS

International Search Report issued in Application No. PCT/JP2009/002516; dated Jul. 21, 2009 (with translation).

* cited by examiner

*Primary Examiner* — Robert Rose
(74) *Attorney, Agent, or Firm* — Oliff & Berridge, PLC

(57) ABSTRACT

The present invention is a method for slicing a workpiece into wafers by pressing a cylindrical workpiece held with a workpiece holder against a wire row formed by a wire spirally wound between a plurality of wire guides and making the wire travel while supplying a slurry to a contact portion between the workpiece and the wire, wherein the workpiece is sliced with an axis direction of the workpiece inclined with respect to a plane formed by the wire row, after the workpiece is inclined in such a manner that a side far from the wire row plane is a side where the wire guides are to be axially expanded. As a result, there is provided a method for slicing that enable wafers having a good Warp shape to be obtained by precisely slicing a workpiece with a wire saw.

16 Claims, 4 Drawing Sheets

(A)

(B)

(A)

(B)

(A)

(B)

METHOD FOR SLICING WORKPIECE

TECHNICAL FIELD

The present invention relates to a method for slicing a workpiece into wafers with a wire saw.

BACKGROUND ART

A wire saw is an apparatus in which a workpiece is pressed against a wire row spirally wound between a plurality of wire guides (grooved rollers), an abrasive fluid in a slurry state obtained by mixing free-abrasive grains into an oily or an aqueous coolant is supplied to a contact portion between the workpiece and a wire, and thereby the workpiece is sliced into many wafers by a grinding effect of the free-abrasive grains. Specifically, the free-abrasive grains in the supplied abrasive fluid are pushed into an inner portion of a wire groove (a slicing groove of the workpiece) by the wire to scrape a bottom portion of the groove of the workpiece while making the wire row travel in a reciprocating direction so that the workpiece is sliced.

As described above, the workpiece is sliced into wafers by scraping the free-abrasive grains on the inner portion of the wire groove (the slicing groove of the workpiece) by the wire traveling in a reciprocating direction. Friction that occurs in this case causes generation of heat at a slicing portion and thereby the workpiece is thermally expanded during slicing. Moreover, the wire guides are axially expanded by thermal expansion under frictional heat between the wire and the wire guides and under frictional heat generated at a bearing portion, which sustains the wire guides. A relative position of the workpiece with respect to the wire row, which is spirally wound between the wire guides, consequently changes during slicing.

A change in the relative position between the workpiece and the wire row, which is caused by the thermal expansion of the workpiece and the expansion in an axial direction of the wire guides, brings about inflecting slicing trajectory depicted in the workpiece by the wire. There arises a problem that this inflection of the slicing trajectory is detected as Warp in a shape measurement after wafer processing.

As a measure against the above-mentioned problem, with regard to the expansion in an axial direction of wire guides, Japanese Unexamined Patent publication (Kokai) No. 8-323741 discloses a method of controlling the expansion in an axis direction of main rollers (wire guides) by circulating coolant water in bearings of the main rollers (the wire guides). With regard to the expansion of a workpiece, Japanese Patent No. 3734018 discloses a method of controlling the temperature of a workplace by supplying a temperature control medium to the workplace.

According to the measures disclosed in the above patent documents, Warp of a sliced wafer is somewhat improved by suppressing the expansion in an axial direction of the wire guides and the thermal expansion of the workpiece and by preventing the relative position of the workpiece with respect to the wire row, which is spirally wound between the wire guides, from changing during slicing. However, an amount of the improvement is insufficient.

DISCLOSURE OF INVENTION

The present invention was accomplished in view of the above-explained problems, and its object is to provide a method for slicing that enable wafers having a good Warp shape to be obtained by precisely slicing a workpiece with a wire saw.

To achieve this object, the present invention provides a method for slicing a workpiece into wafers by pressing a cylindrical workpiece held with a workpiece holder against a wire row formed by a wire spirally wound between a plurality of wire guides and making the wire travel while supplying a slurry to a contact portion between the workpiece and the wire, wherein the workpiece is sliced with an axis direction of the workpiece inclined with respect to a plane formed by the wire row, after the workpiece is inclined in such a manner that a side far from the wire row plane is a side where the wire guides are to be axially expanded.

In this manner, when the workpiece is sliced with the axis direction of the workpiece inclined, a position of the wire is moved along the inclination by bringing the workpiece contact with the wire and pressing it before cutting at the start of slicing, and the slicing of the workpiece is thereby started at the moved position. As the slicing proceeds, force acts to put the wire back to the original position, and a slicing trajectory of the workpiece tends to be inflected. On the other hand, the wire guides heat up and axially expand by thermal expansion as the slicing proceeds, force thereby acts on the wire in the direction of axially expanding the wire guides, and the slicing trajectory tends to be inflected in the same direction as the expansion of the wire guides.

In the present invention, the workpiece is sliced after the workpiece is inclined in such a manner that the side far from the wire row plane is the side where the wire guides are to be axially expanded so that the inflections caused by these two factors occur in the opposite direction to one another. The inflections of the slicing trajectories caused by these two factors can be thus offset, and it can be straightly sliced. It can be consequently sliced into the wafers having a good Warp shape.

Moreover, since an effect of the present invention can be exerted only by inclining the workpiece axis in the direction predetermined by the present invention, any special devices are not necessary, and it can be sliced well at low cost.

In this case, an inclination angle of the axis direction of the workpiece is preferably set based on a slicing trajectory of a workpiece previously sliced.

In this manner, an amount and a direction of the expansion of each wire guide depending on apparatus characteristics or a size of the inflection of the slicing trajectory can be understood based on the slicing trajectory of the workpiece previously sliced, and an effective inclination angle can be therefore set in the next slicing using this.

In this case, the inclination angle of the axis direction of the workpiece is preferably adjusted to an absolute value ranging from 0.003° to 0.2°.

When the inclination angle is adjusted in the range described above, the inflection of the slicing trajectory can be more effectively prevented, and it can be consequently sliced into the wafers having a good Warp shape.

In this case, the inclination of the axis direction of the workpiece is preferably adjusted by inclining the workpiece holder for holding the workpiece, by an inclined shape of a member inserted between the workpiece and the workpiece holder, or by inclining a workpiece-holding-portion attached with the workpiece holder.

In this manner, when the inclination of the axis direction of the workpiece is adjusted by the method described above, any special devices are not necessary for carrying out the present invention, the inclination can be readily adjusted, and it can be consequently sliced into the wafers having a good Warp shape at low cost by a simple and convenient method.

These methods can be naturally combined to use.

As described above, when the workpiece is sliced with the workpiece inclined in the direction defined in the present invention according to the method for slicing a workpiece of the present invention, the inflection of the slicing trajectory in the opposite direction to the inflection of the slicing trajectory of the workpiece due to the expansion in an axial direction of wire guides are made occur, the inflections caused by two factors are thereby offset, and the workpiece can be therefore sliced straightly. That is to say, the slicing is started at the deliberately moved position of the wire by slicing the workpiece with it axially inclined so that the inflection of the slicing trajectory due to the force acting to put the wire back to the original position during slicing occurs in the opposite direction to the side where the wire guides are to be axially expanded. The slicing can be thereby performed well in which the inflection of the slicing trajectory is prevented, and it can be sliced into the wafers having improved Warp. In addition, a conventional apparatus can be basically used, any special devices are not necessary, and it can be therefore sliced well at low cost.

BEST MODE FOR CARRYING OUT THE INVENTION

When the workpiece is sliced with a wire saw, particularly a thrust type wire guide, in which only one end can expand, expands large in one direction, and a change in the relative position between the workpiece and the wire row, which is caused by thermal expansion, becomes large. The slicing trajectory depicted in the workpiece by the wire is therefore inflected. There has been the problem that this inflection of the slicing trajectory is detected as Warp in a shape measurement after wafer processing. The inflection caused by heat as above can be prevented to a certain degree by using the above-described method such as use of coolant water. However, the improvement of Warp of the sliced workpiece has been insufficient.

The present inventors repeatedly keenly conducted studies of the Warp shape of the sliced wafer. As a result, the present inventors have found that, in the event that the workpiece is sliced with it slightly inclined, cutting in the workpiece is started after the wire skids on a surface of a cylindrical workpiece in an axis direction at a start part of slicing the workpiece, and an another inflection of the slicing trajectory occurs by a position of the wire being put back to a position before the skid with the progress of the slicing, in addition to the inflection due to heat generated during slicing as described above.

The present inventors have further found from the above-described finding that, by slicing the workpiece with the axis direction of the workpiece inclined with respect to the wire row plane, the inflections of the slicing trajectories caused by two factors can be offset, because the cutting is started after deliberately skidding the wire in the direction of the side where the wire guides are to be axially expanded, the wire guides axially expands before the wire is put back to the original position during the slicing, and a slicing position of the workpiece becomes the same as a position of the wire in the expanded wire guides so that the slicing is not inflected and straightly proceeds, and brought the present invention to completion.

Hereinafter, an example of an embodiment of the method for slicing a workpiece according to the present invention will be explained in detail with reference to the drawings, but the present invention is not restricted thereto.

Figure 1:
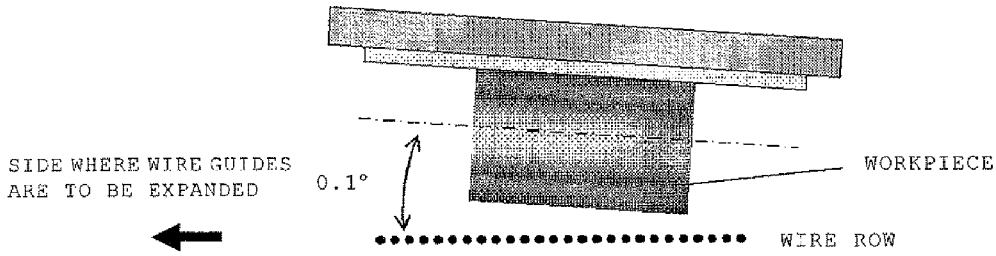
FIG. 1(A) is a side view showing a workpiece status before slicing in the slicing of the workpiece in Example.
FIG. 1(B) shows the slicing trajectory in Example.
Figure 1:
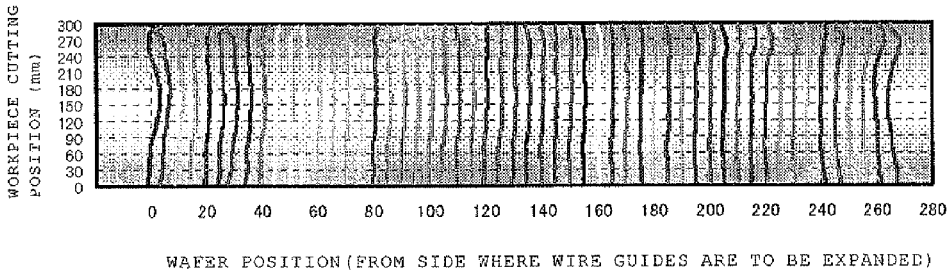

It is to be noted that FIG. 1(A) is a side view showing a condition where the workpiece is held in a wire saw with it inclined, and FIG. 1(B) is a view showing its slicing trajectory, as an example of an embodiment of the method for slicing a workpiece according to the present invention.

Figure 6:
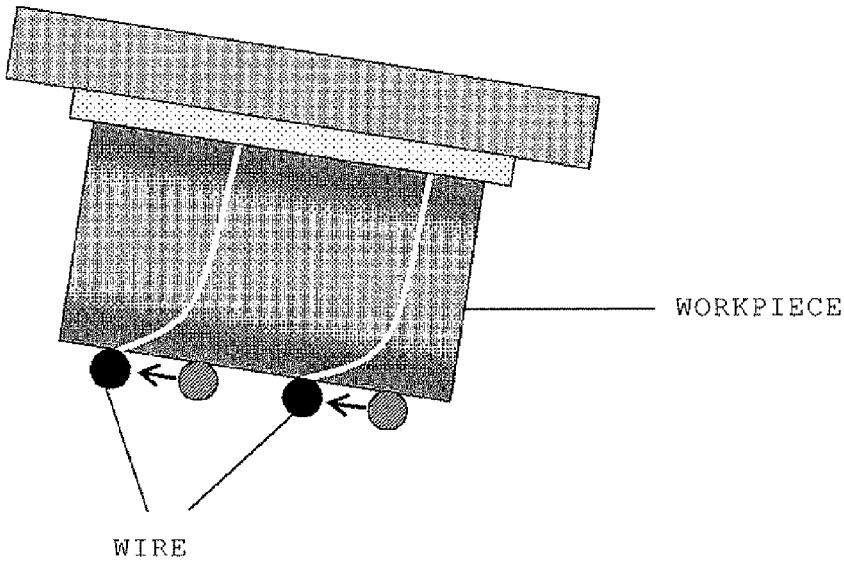
FIG. 6 is an explanatory view showing an influence on the slicing trajectory due to the inclination in an axial direction of the workpiece.
Figure 7:
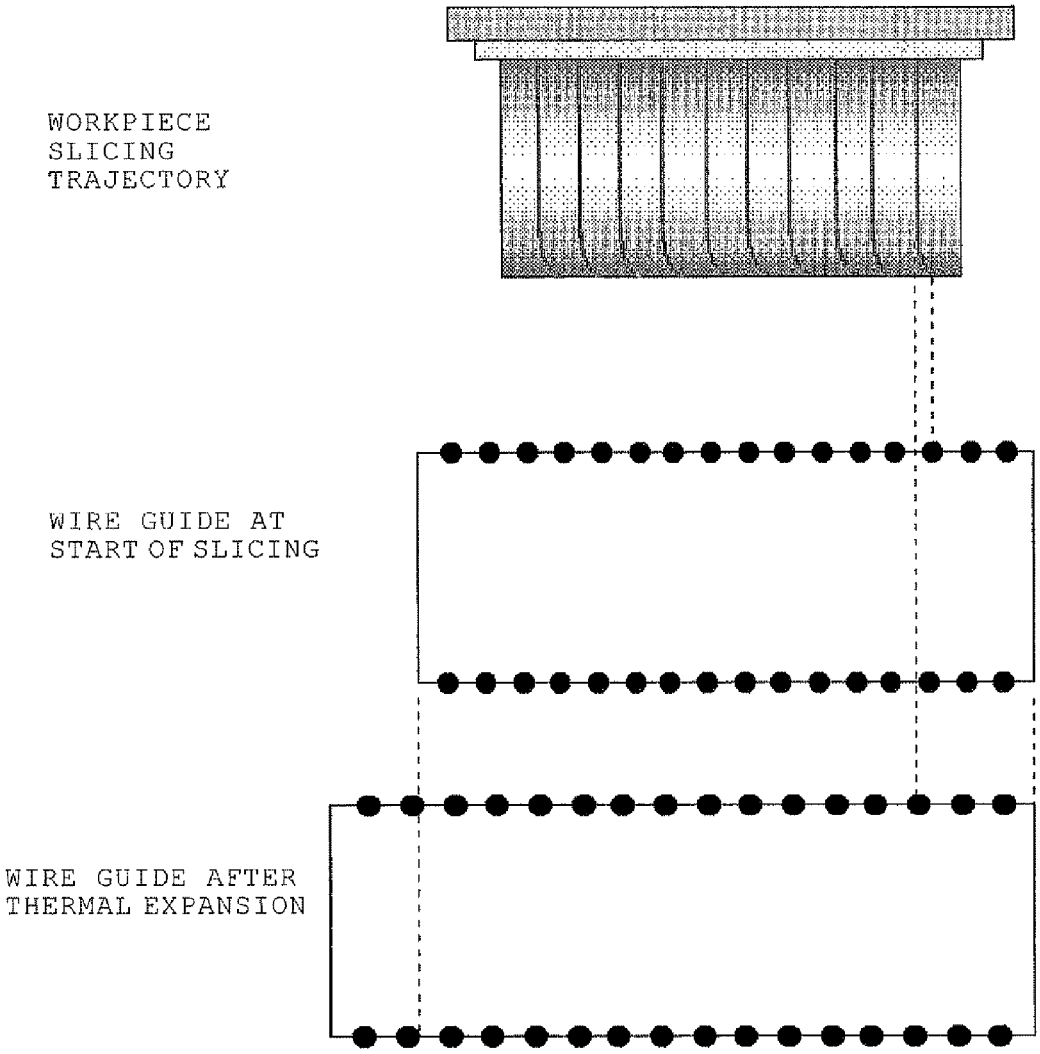
FIG. 7 is an explanatory view showing an influence on the slicing trajectory of the workpiece due to the expansion in an axial direction of the wire guides.

FIG. 6 is an explanatory view showing an influence on the slicing trajectory due to the inclination in an axial direction of the workpiece. FIG. 7 is an explanatory view showing an influence on the slicing trajectory of the workpiece due to the expansion in an axial direction of the wire guides.

Figure 4:
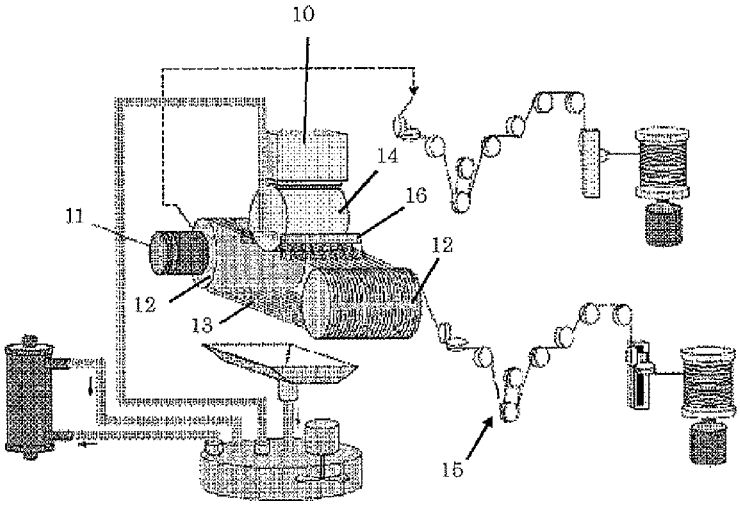
FIG. 4 is a schematic view showing a wire saw apparatus used in the method for slicing a workpiece according to the present invention.
Figure 5:
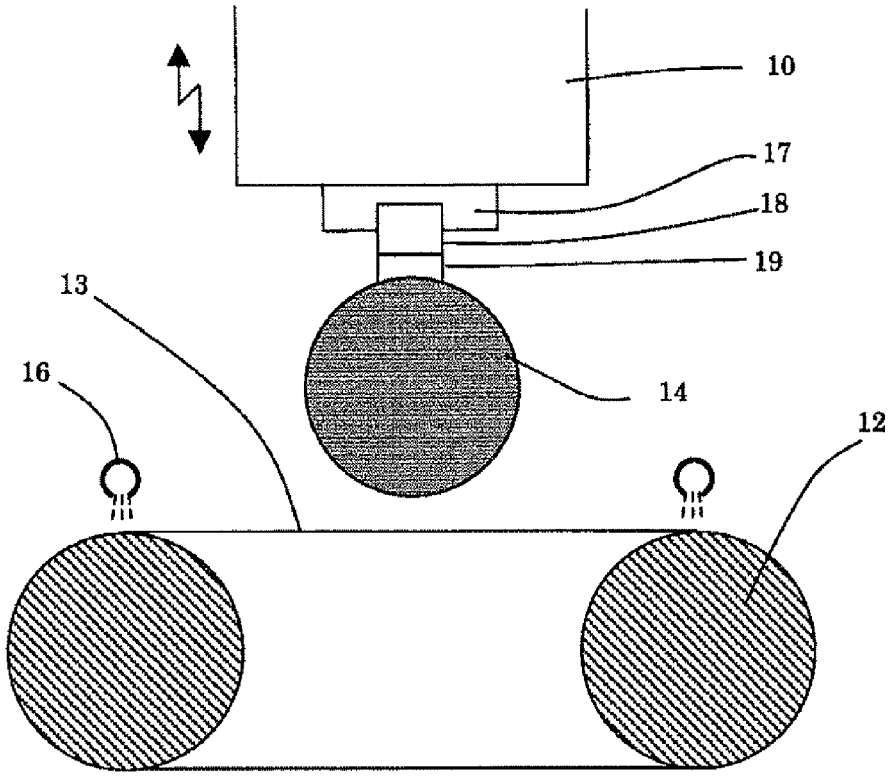
FIG. 5 is an explanatory view of slicing a workpiece with the wire saw apparatus used in the method for slicing a workpiece according to the present invention.

First, FIG. 4 is a schematic view showing an example of a wire saw apparatus used in the method for slicing according to the present invention. FIG. 5 is an explanatory view of slicing the workpiece with the wire saw apparatus.

In the method for slicing according to the present invention, since special devices are not necessary except for a part of holding the workpiece, a conventional wire saw apparatus can be basically used.

The wire saw apparatus shown in FIG. 4 has the wire 13 for slicing the workpiece 14, the wire guides 12 for winding the wire 13, each wire guide of which one end is fixed, a driving motor 11 for driving the wire guides 12, a mechanism 15 for providing the wire 13 with tension, a mechanism 10 for holding and feeding the workpiece 14 to be sliced, and slurry nozzles 16 for supplying a slurry during slicing.

As shown in FIG. 5, the workpiece-feeding-mechanism 10 is provided with a workpiece-holding-portion 17 and a workpiece holder 18. A slice base 19 is inserted between the workpiece 14 to be sliced and the workpiece holder 18.

In the present invention, as shown in FIG. 1(A), when the workpiece 14 is sliced with the wire saw apparatus having the structure as above, the workpiece is sliced with the axis direction of the workpiece 14 inclined with respect to the plane formed by the wire row 13, after the workpiece 14 is inclined in such a manner that the side far from the plane of the wire row 13 is the side where the wire guides 12 are to be axially expanded.

When the workpiece is sliced with the workpiece inclined as described above, the wire is moved before cutting by pressing the workpiece against the wire, and the moved position from the position of the wire guides where the wire lines up becomes the start position of slicing. The slicing trajectory is therefore inflected in the direction from the moved position to the original position by the force acting to put the wire back to the original position as the slicing proceeds (See FIG. 6).

On the other hand, since the wire guides heat up and axially expand as the slicing proceeds, the wire unreeled from each wire guide is also moved in the same direction, and the slicing trajectory of the workpiece is inflected in the direction of the side where the wire guides are expanded (See FIG. 7).

In the present invention, since the inclination is adjusted in such a manner that the inflections caused by these two factors occur in the opposite direction to one another, the two inflections are offset, and the slicing straightly proceeds. The Warp of the sliced wafer can be thereby improved only by holding with the workpiece inclined according to the method of the present invention, without using special devices, and it can be sliced well at low cost.

In this case, an inclination angle of the axis direction of the workpiece is preferably set based on the slicing trajectory of the workpiece previously sliced.

In this way, the direction and the degree of the inflection of the slicing trajectory can be examined based on the slicing trajectory of the workpiece previously sliced, the inclination angle can be thereby readily set, next slicing can be more effectively performed well. Accordingly, a product is preferably sliced after previously slicing a dummy workpiece to examine the trajectory.

Figure 2:
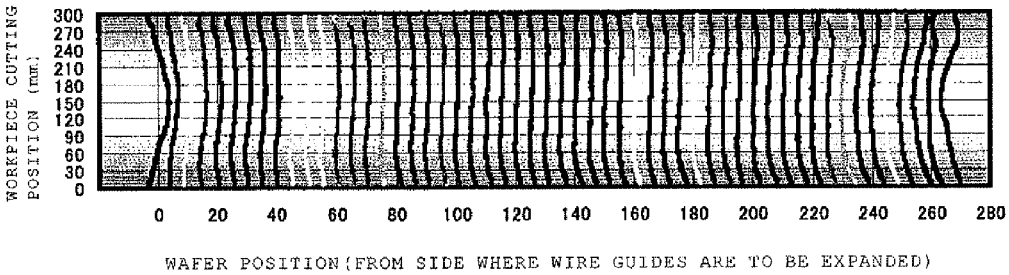
FIG. 2 is a view showing the slicing trajectory when the workpiece has been sliced with the axis direction of the workpiece slightly inclined with respect to the wire row plane.

FIG. 2 shows the slicing trajectory of the workpiece obtained as a result of measuring a shape of the wafer sliced while the workpiece was held with it slightly inclined with respect to the wire row plane, specifically in a condition where the inclination angle of the workpiece was adjusted to 0.003°.

In the slicing trajectory shown in FIG. 2, it can be confirmed that the slicing trajectory is inflected toward a scale of zero of a wafer position at the beginning of slicing, and that the wire guides thus axially expanded in the direction of the scale of zero of a horizontal axis (the wafer position).

Accordingly, the inclination angle can be further set in conditions where the workpiece is inclined in such a manner that a side of the scale of zero of the horizontal axis (the side where the wire guides are to be axially expanded) is the side far from the wire row plane.

In this case, the inclination angle of the axis direction of the workpiece 14 is preferably adjusted to an absolute value ranging from 0.003° to 0.2°.

Given the expansion of the wire guides and the like, when the inclination angle is adjusted in the range described above, the inflection of the slicing trajectory of the workpiece can be more effectively prevented, and it can be consequently sliced into the wafers having a good Warp shape.

In this case, the inclination of the axis direction of the workpiece 14 is preferably adjusted by inclining the workpiece holder 18 for holding the workpiece 14, by an inclined shape of the member inserted between the workpiece 14 and the workpiece holder 18 (for example, the slice base 19), or by an angle-adjusting-mechanism of a workpiece-holding-portion 17 attached with the workpiece holder 18. Furthermore, these methods may be combined to use for more finely adjusting.

In this way, the inclination of the workpiece can be adjusted by a simple and convenient method without using special devices, and it can be therefore sliced well at low cost.

Hereinafter, the present invention will be explained in more detail based on Examples and Comparative Example, but the present invention is not restricted thereto.

Example 1

First, the wire saw apparatus as shown in FIG. 4 was used to slice a silicon ingot (a workpiece) having a diameter of 300 mm and an axial length of 300 mm in slicing conditions shown in Table 1. The supply temperature of the slurry was controlled to be a constant temperature of 23° C. from the start of slicing to the end of slicing.

TABLE 1

| | | SLICING CONDITIONS |
|---|---|---|
| WORKPIECE | INGOT DIAMETER | ø 300 mm |
| WIRE | WIRE DIAMETER | 160 μm |
| | WIRE TENSION | 2.5 kgf |
| | NEW WIRE LINE SUPPLY AMOUNT | 100 m/min |
| | WIRE REVERSAL CYCLE | 60 s |
| | WIRE TRAVELING SPEED | AVERAGE 500 m/min |
| SLURRY | ABRASIVE GRAIN | GC# 1000 |
| | ABRASIVE GRAIN CONCENTRATION (COOLANT: ABRASIVE GRAIN) | 50:50 (WEIGHT RATIO) |

The workpiece was fixed in such a manner that a resin slice base was fixed by adhering to an upper surface of a metal workpiece holder, and the workpiece was adhered onto the resin slice base. When the workpiece was set to the wire saw apparatus, a set of the metal workpiece holder, the resin slice base, and the workpiece, which was fixed by these adhesion, was turned upside down, and the workpiece holder was fixed and held by the workpiece-holding-portion of the wire saw apparatus, in conditions where the workplace holder was located above and the workpiece is hung and held (See FIG. 5).

When the resin slice base was adhered to the workpiece holder and the workpiece was adhered, they were adhered after adjusting shape accuracy of the workpiece holder and of the resin slice base, and parallelism of the workpiece holder, the resin slice base and the workpiece so as to parallel a surface of a workpiece plate with respect to the workpiece axis.

The workpiece adhered to the workpiece holder was fixed and held, in the wire saw apparatus, with it slightly inclined. As a result of measuring the inclination angle between the plane formed by the wire row and the workpiece axis, the side where the wire guides are to be axially expanded was inclined to the side far from the wire row plane by 0.003° (11 seconds).

An average value of the Warp of all wafers sliced from the workpiece in the above-described condition was 7.4 μm. FIG. 2 shows Warp shapes of a cross section in a workpiece feeding direction of wafers picked up every 5 wafers after the fifth wafer, such as first, fifth, tenth . . . , from measured data of the Warp. It is revealed that the inflection of the slicing trajectory is relatively suppressed at the beginning of slicing.

In Example 1, since the workpiece axis was relatively near to be parallel with respect to the plane formed by the wire row, the skid of the wire did not occur at the start part of slicing, deterioration of the Warp due to the inflection of the slicing trajectory caused by the moved wire was consequently suppressed and the inflection of the slicing trajectory caused by the expansion in an axial direction of the wire guides was still observed.

Example 2

The slicing trajectory shown in FIG. 2 reveals that when one end face of a wire guide (a side of a horizontal axis scale of 280 in FIG. 2) is set as a reference position, the wire guide of the wire saw apparatus used in Example 1 was axially expanded in the direction of the other end face (a side of a horizontal axis scale of zero in FIG. 2).

In view of this, in order to effectively offset the inflection of the slicing trajectory formed due to the expansion in an axial direction of the wire guides by the inflection of the slicing trajectory due to the skid of the wire, the workpiece was held in conditions where the workpiece axis was inclined by 0.1° in such a manner that the side far from the wire row plane was the side where the wire guides were to be axially expanded, as shown in FIG. 1(A). A silicon ingot having a diameter of 300 mm and an axial length of 300 mm was sliced in the same conditions as Example 1 except for the inclination angle. The inclination of the workpiece axis was adjusted by a shape of inclining a thickness of the workpiece holder in a longitudinal direction.

FIG. 1(B) shows Warp shapes of a cross section in a workpiece feeding direction of wafers picked up every 5 wafers after the fifth wafer, such as first, fifth, tenth . . . , from measured data of the Warp of the wafer sliced from the workpiece in the above-described condition. As shown in FIG. 1(B), the inflection of the slicing trajectory was hardly observed, particularly at the beginning of slicing. An average value of the Warp of all wafers was 6.3 μm, which was improved in comparison with the wafer sliced with it slightly inclined in Example 1.

It is to be noted that a standard of a wafer plane orientation is one of quality items for silicon single crystals, and when slicing is performed with the workpiece axis deliberately inclined as the present invention, it is concerned that the plane orientation of a sliced wafer deviates by the inclination angle of the workpiece axis. With respect to this, the influence can be removed by moving the orientation of the workpiece by the inclination angle of the workpiece axis in advance.

Comparative Example

Figure 3:
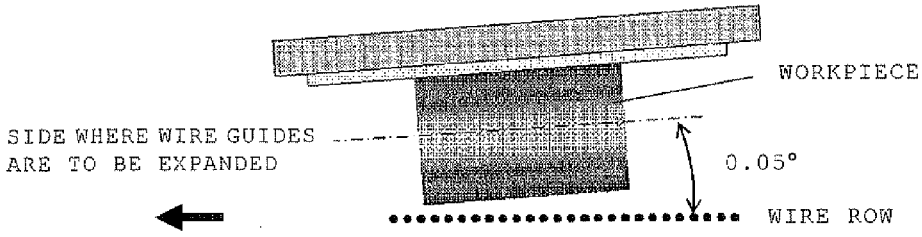
FIG. 3(A) is a side view showing a workpiece status before slicing in the slicing of the workpiece in Comparative Example.
FIG. 3(B) shows the slicing trajectory in Comparative Example.
Figure 3:
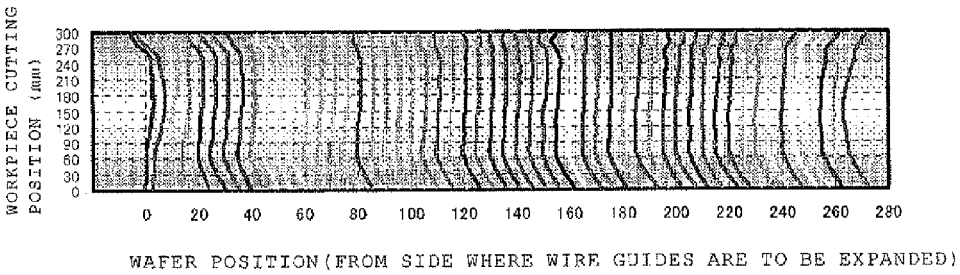

A silicon ingot having a diameter of 300 mm and an axial length of 300 mm was sliced in the same conditions as Examples 1 and 2 except for inclining the workpiece axis by 0.05° (3 minute) with respect to the plane formed by the wire row in the opposite direction to Examples 1 and 2, as shown in FIG. 3(A). As the inclination angle of the workpiece axis, adopted was the maximum value obtained by, several times, investigating the inclination angle after adhering without adjustments of the inclination angle of the workpiece holder and the workpiece.

An average value of the Warp of all wafers sliced from the workpiece in the above-described condition was 9.2 μm. FIG. 3(B) shows Warp shapes of a cross section in a workpiece feeding direction of wafers picked up every 5 wafers after the fifth wafer, such as first, fifth, tenth . . . , from measured data of the Warp.

The skid of the wire occurred at the start part of slicing due to the inclination of the workpiece, and the inflection occurred in the same direction as the inflection due to the expansion in an axial direction of the wire guides. The slicing trajectory of the workpiece was therefore greatly inflected, and the Warp was deteriorated.

It is to be noted that the present invention is not restricted to the foregoing embodiment. The embodiment is just an exemplification, and any examples that have substantially the same feature and demonstrate the same functions and effects as those in the technical concept described in claims of the present invention are included in the technical scope of the present invention.

The invention claimed is:

1. A method for slicing a workpiece into wafers by pressing a cylindrical workpiece held with a workpiece holder against a wire row formed by a wire spirally wound between a plurality of wire guides in which only one end can expand, and making the wire travel while supplying a slurry to a contact portion between the workpiece and the wire, wherein the workpiece is sliced with an axis direction of the workpiece inclined with respect to a plane formed by the wire row, after the workpiece is inclined in such a manner that a side far from the wire row plane is a side of the one end of the wire guides that can expand, where the wire guides are to be axially expanded.

2. The method for slicing a workpiece according to claim 1, wherein an inclination angle of the axis direction of the workpiece is set based on a slicing trajectory of a workpiece previously sliced.

3. The method for slicing a workpiece according to claim 1, wherein the inclination angle of the axis direction of the workpiece is adjusted to an absolute value ranging from 0.003° to 0.2°.

4. The method for slicing a workpiece according to claim 2, wherein the inclination angle of the axis direction of the workpiece is adjusted to an absolute value ranging from 0.003° to 0.2°.

5. The method for slicing a workpiece according to claim 1, wherein the inclination of the axis direction of the workpiece is adjusted by inclining the workpiece holder for holding the workpiece.

6. The method for slicing a workpiece according to claim 2, wherein the inclination of the axis direction of the workpiece is adjusted by inclining the workpiece holder for holding the workpiece.

7. The method for slicing a workpiece according to claim 3, wherein the inclination of the axis direction of the workpiece is adjusted by inclining the workpiece holder for holding the workpiece.

8. The method for slicing a workpiece according to claim 4, wherein the inclination of the axis direction of the workpiece is adjusted by inclining the workpiece holder for holding the workpiece.

9. The method for slicing a workpiece according to claim 1, wherein the inclination of the axis direction of the workpiece is adjusted by an inclined shape of a member inserted between the workpiece and the workpiece holder.

10. The method for slicing a workpiece according to claim 2, wherein the inclination of the axis direction of the workpiece is adjusted by an inclined shape of a member inserted between the workpiece and the workpiece holder.

11. The method for slicing a workpiece according to claim 3, wherein the inclination of the axis direction of the workpiece is adjusted by an inclined shape of a member inserted between the workpiece and the workpiece holder.

12. The method for slicing a workpiece according to claim 4, wherein the inclination of the axis direction of the workpiece is adjusted by an inclined shape of a member inserted between the workpiece and the workpiece holder.

13. The method for slicing a workpiece according to claim 1, wherein the inclination of the axis direction of the workpiece is adjusted by inclining a workpiece-holding-portion attached with the workpiece holder.

14. The method for slicing a workpiece according to claim 2, wherein the inclination of the axis direction of the workpiece is adjusted by inclining a workpiece-holding-portion attached with the workpiece holder.

15. The method for slicing a workpiece according to claim 3, wherein the inclination of the axis direction of the workpiece is adjusted by inclining a workpiece-holding-portion attached with the workpiece holder.

16. The method for slicing a workpiece according to claim 4, wherein the inclination of the axis direction of the workpiece is adjusted by inclining a workpiece-holding-portion attached with the workpiece holder.

* * * * *